United States Patent [19]

Beran

[11] Patent Number: 4,483,380

[45] Date of Patent: Nov. 20, 1984

[54] FOLDABLE PROTECTIVE COVER AND CARRIER FOR SPORTS EQUIPMENT

[75] Inventor: Mark A. Beran, Niwot, Colo.

[73] Assignee: BC Creations, Inc., Niwot, Colo.

[21] Appl. No.: 454,131

[22] Filed: Dec. 29, 1982

[51] Int. Cl.[3] ..... B65D 81/02; B65D 85/00; A63C 15/06

[52] U.S. Cl. ..... 150/52 R; 206/315.1; 206/523; 224/917

[58] Field of Search ..... 150/52 R, 52 B, 52 F, 150/52 K; 190/1, 2; 224/917; 294/147, 150; 229/87 R, 87 A, 87 H; 206/523, 492, 315.1

[56] References Cited

U.S. PATENT DOCUMENTS

| | | | |
|---|---|---|---|
| D. 204,431 | 4/1966 | Glasgow | D21/230 |
| 429,766 | 6/1890 | Lee | 294/150 X |
| 623,338 | 4/1899 | Schloerb | 294/150 X |
| 751,190 | 2/1904 | Martin | 190/2 |
| 1,221,100 | 4/1917 | Smith et al. | 150/52 R |
| 1,505,797 | 8/1924 | Olstad | 150/52 R |
| 1,550,469 | 8/1925 | Tilden | 150/52 F |
| 1,552,563 | 9/1925 | Labisky | 150/52 R X |
| 1,719,364 | 7/1929 | Gilkey | 150/52 R |
| 1,822,899 | 9/1931 | Malis | 150/52 F |
| 2,071,222 | 2/1937 | Ashley | 224/917 X |
| 2,346,908 | 4/1944 | Corley | 150/52 R |
| 2,502,033 | 3/1950 | Bohn | 150/52 R X |
| 2,551,929 | 5/1951 | Collins | 150/52 R X |
| 2,659,404 | 11/1953 | Kelsey | 150/52 R X |
| 2,854,775 | 10/1958 | Kleckley | 150/52 R X |
| 3,339,607 | 9/1967 | Howard | 150/52 R |
| 3,575,327 | 4/1971 | Harrison | 150/52 R X |
| 3,851,689 | 12/1974 | Kohls | 150/3 X |
| 4,191,233 | 3/1980 | McKay | 150/52 R |
| 4,301,920 | 11/1981 | Boggs | 150/52 R X |
| 4,402,355 | 9/1983 | Wymore et al. | 150/52 R |

FOREIGN PATENT DOCUMENTS

| | | | |
|---|---|---|---|
| 318337 | 2/1957 | Switzerland | 224/917 |

*Primary Examiner*—William Price
*Assistant Examiner*—Sue A. Weaver
*Attorney, Agent, or Firm*—O'Rourke & Harris

[57] ABSTRACT

A foldable protective cover and carrier is disclosed that is particularly useful for sports equipment. The cover includes an outer layer of environmental protective material such as nylon and an inner layer of cushioning material such as foam plastic. A pocket is provided at each longitudinal end of the cover at the inner side, and four laterally extending straps are spaced along the outer layer of material with two straps being at the longitudinal ends and the other two inwardly thereof. Reinforcing strips extend laterally across the longitudinal ends of the cover and a third reinforcing strip having a fifth strap connected therewith extends between the inwardly positioned straps to form a handle at one side edge when the cover is fully assembled. Sports equipment, such as a surfboard, is placed on the inner side of the unfolded cover, preferably with the bottom facing upwardly, and the cover is then folded over the surfboard in an overlapping fashion to provide a dual layer of protection for the bottom of the board. The pair of inwardly positioned straps are then fastened about the board, after which the ends of the cover are folded around the board ends in such a manner that the dual layer of protection wraps continuously around the delicate nose and tail of the board, after which the end straps are then fastened. The handle is then adjusted for shoulder or hand carrying as preferred.

15 Claims, 10 Drawing Figures

FOLDABLE PROTECTIVE COVER AND CARRIER FOR SPORTS EQUIPMENT

FIELD OF THE INVENTION

This invention relates to a protective cover and, more particularly, relates to a foldable protective cover for sports equipment.

BACKGROUND OF THE INVENTION

It is oftentimes desirable to provide a protective cover for various articles. Such covers have assumed various shapes and dimensions depending upon the nature of the article, and such covers have been used for other auxiliary purposes, such as, for example, being used as a towel or the like (see, for example, U.S. Pat. No. 2,659,404), and such covers have heretofore been folded and attached by straps to a luggage carrier or the like (see, for example, U.S. Pat. No. 1,552,563).

Covers for protecting sports equipment have also been heretofore suggested, and, more particularly, protective covers for elongated sports equipment, such as, for example, surfboards and skis, having portions more sensitive to damage have also been heretofore suggested.

Surfboard covers have, for example, been heretofore proposed that were fitted to the particular board (see, for example, U.S. Pat. No. 3,339,607 and Design Patent No. 204,431), and ski bags have been heretofore proposed for receiving a pair of skis with the excess material at the open end of the sleeve type bag being folded over the rear ends of the skis (see, for example, U.S. Pat. No. 3,851,689).

While protective coverings have been heretofore suggested for sports equipment such as surfboards and skis, such coverings have not heretofore provided the degree of protection needed for adequately and continuously protecting such sports equipment including protecting sensitive portions of such equipment, such as the ends and bottom of a surfboard, for example.

SUMMARY OF THE INVENTION

This invention provides an improved protective cover that is particularly well suited for sports equipment, with the cover providing improved protection for sensitive portions of such equipment. The cover, when fully assembled, provides a carrier for the equipment and when unwrapped can be used for auxiliary purposes such as a beach pad or sleeping bag, for example.

It is therefore an object of this invention to provide an improved protective cover.

It is another object of this invention to provide an improved protective cover for sports equipment.

It is still another object of this invention to provide an improved protective cover for sports equipment that provides continuous protection as well as enhanced protection for sensitive portions of the equipment.

It is yet another object of this invention to provide a protective cover which is adaptable to significant variations in length and width of equipment to be protected.

It is still another object of this invention to provide an improved method for providing enhanced protection for the sensitive portions of equipment such as sports equipment.

It is still another object of this invention to provide an improved protective cover that is useful for diverse auxiliary purposes.

With these and other objects in view, which will become apparent to one skilled in the art as the description proceeds, this invention resides in the novel construction, combination, arrangement of parts and method substantially as hereinafter described and more particularly defined by the appended claims, it being understood that such changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
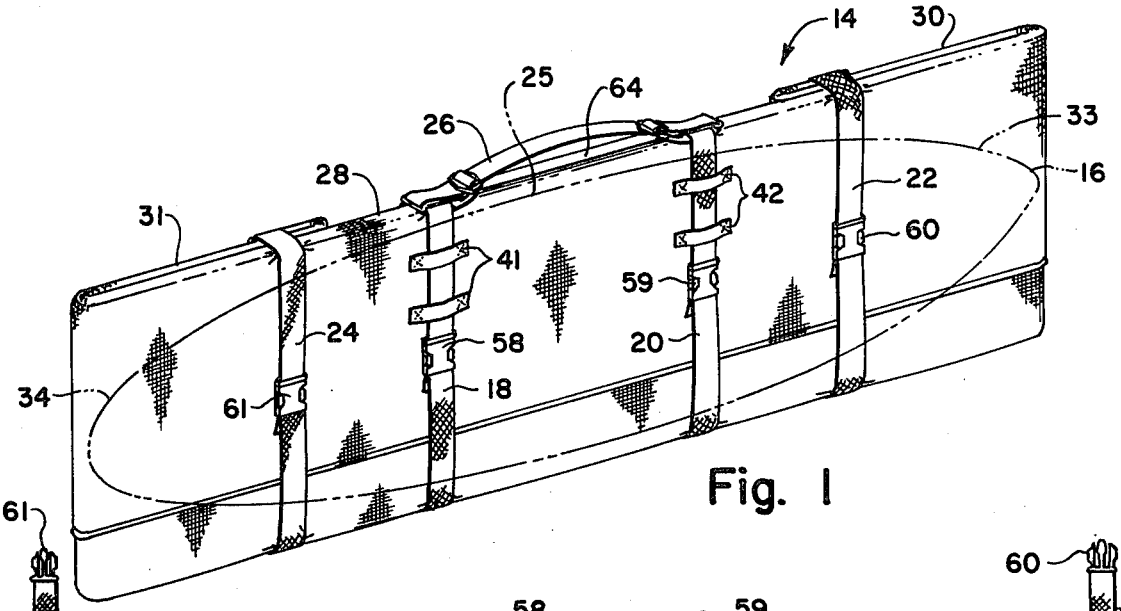
FIG. 1 is a perspective view of the protective cover of this invention in a fully assembled condition protecting a surfboard within the cover and providing a carrier for the board.

The protective cover 14 of this invention is shown in fully assembled condition in FIG. 1 providing protective covering for surfboard 16 and serving as a carrier for the board. As shown in FIG. 1, cover 14 is held in the fully assembled condition by straps 18, 20, 22 and 24, with straps 18 and 20 holding the cover about the central portion 25 of the board and also providing anchoring for handle 26 positioned at top side edge 28 of the fully assembled cover. As also shown in FIG. 1, straps 22 and 24 hold the folded top and bottom end portion 30 and 31 of the cover wrapped about the nose and tail portions 33 and 34, respectively, of board 16 to provide enhanced protection for these sensitive portions of the board.

Figure 2:
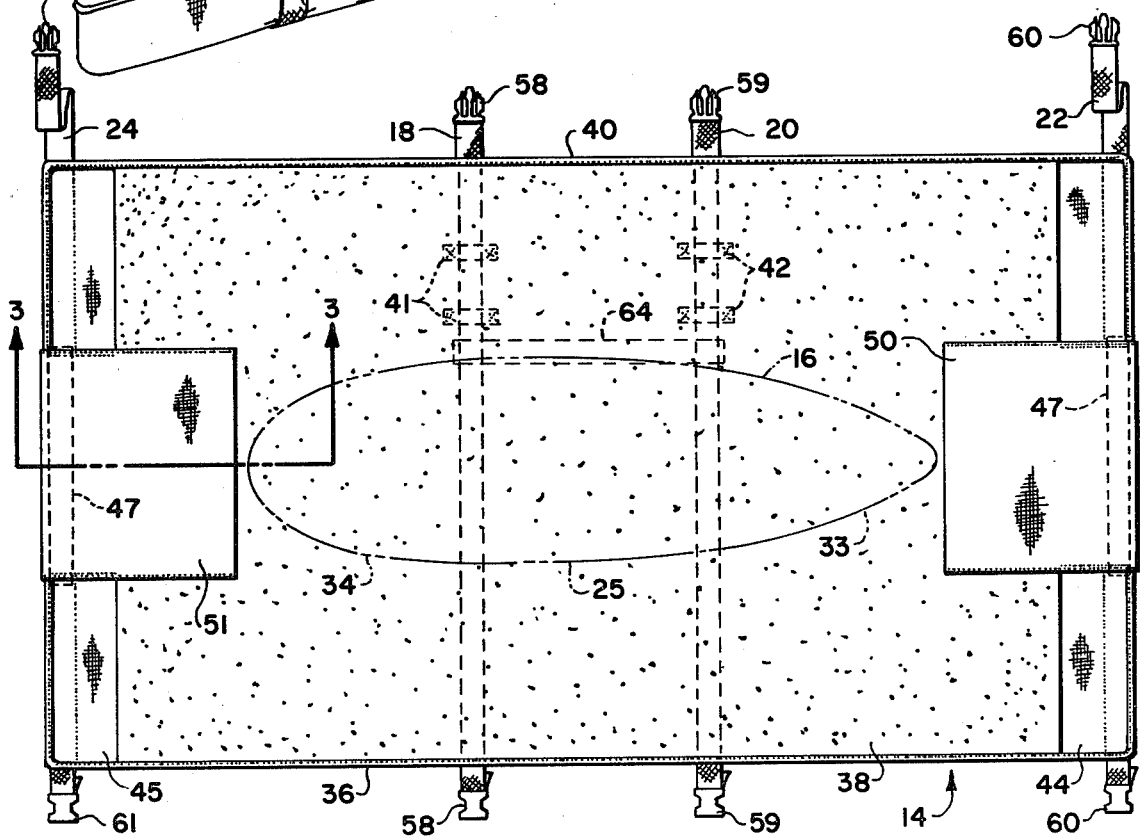
FIG. 2 is a top view of the protective cover shown in FIG. 1 in a fully unfolded condition with a typical surfboard positioned thereon.

Protective cover 14 is shown in FIG. 2 in the fully unassembled (i.e., unfolded) condition. When unfolded, cover 14 is preferably about ten feet by five feet to handle equipment such as surfboards that are commonly five to eight feet in length and seventeen and twenty-four inches in width. In any event, the cover is preferably of sufficient dimensions to adapted for use with many differently dimensioned equipments. As shown, the outer side, or layer, 36 of cover 14 is a thin layer of an environmental protective material such as nylon (preferably cordura nylon). A cushioning layer 38 of foam plastic (such as polyethylene) is positioned on the inner side of the cover and is preferably attached thereto (which can be accomplished by stitching the foam material to the nylon material or adhesively bonding the materials). Laterally extending straps 18 and 20 are mounted to the central portion 40 of the outer side of cover 14 by means of webs 41 and 42, while laterally extending straps 22 and 24 are preferably fastened to the central portion of the longitudinal ends 44 and 45 of cover 14. Laterally extending reinforcing strip 47 is preferably positioned at the longitudinal ends 44 and 45 of the cover by means of webs 48, which strips may be metallic or rigid plastic, are preferably centrally located, and extend for a distance equal to the minimum anticipated width of the equipment to be protected. A pair of pockets 50 and 51 are provided at the ends of the cover. While it is preferable that the pockets be on the inner side, the pockets could be on the outer side and would save material.

Figure 3:
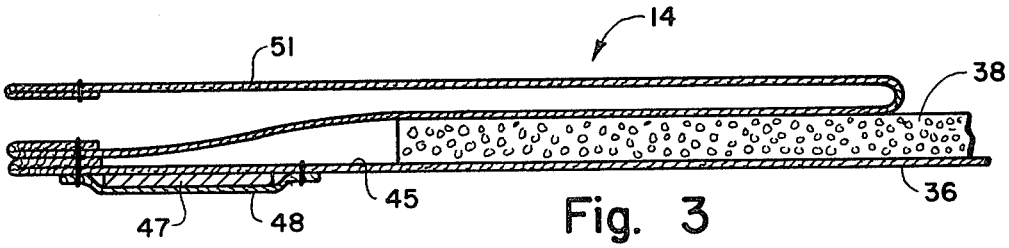
FIG. 3 is a side sectional view taken through lines 3—3 of FIG. 2.

As best shown in the cross-sectional view of FIG. 3, foam portion 38 is relatively thick (about ¼ inch, for example) compared to outer portion 36 (about 4/1000 inches, for example), and, as best shown in FIGS. 2 and 3, pockets 50 and 51 extend well past the edge of foam portion 38 which is recessed from the longitudinal ends of the cover. Pockets 50 and 51 are preferably of nylon and may be of any size as desired.

Figure 4:
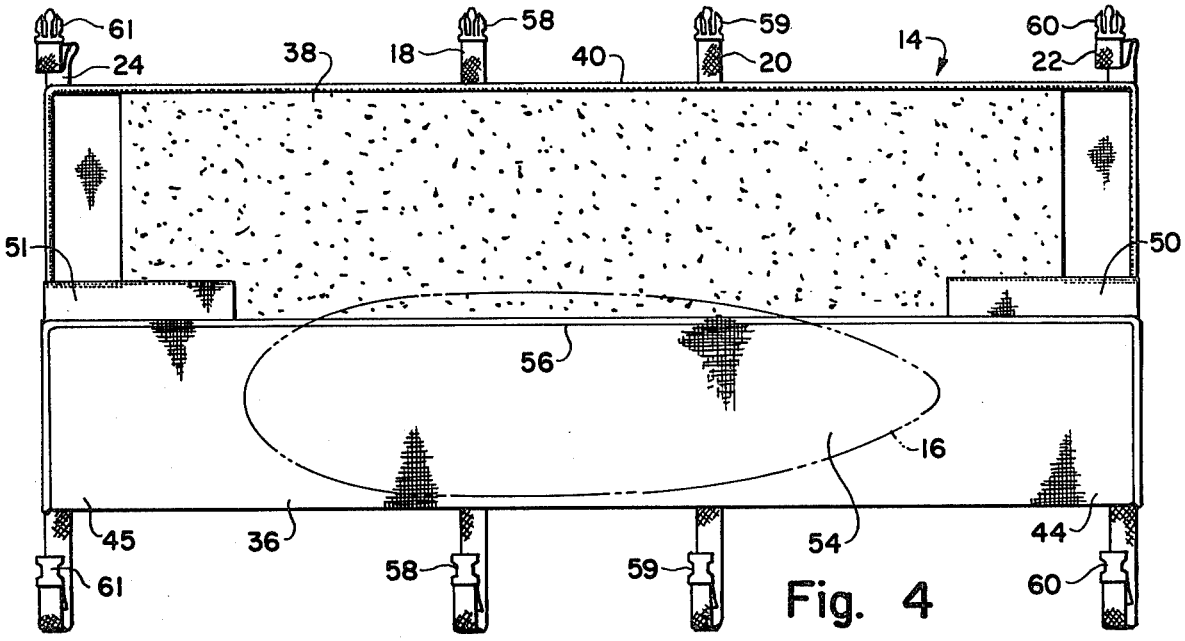
FIGS. 4 and 5 are top views of the protective cover shown in FIGS. 1 and 2 to illustrate progressive folding steps utilized in assembling the cover.
Figure 5:
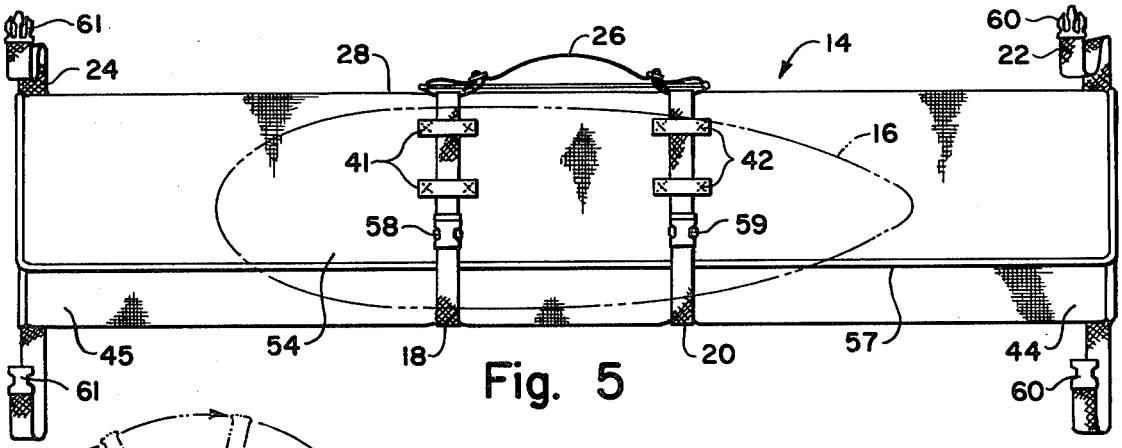

As shown in FIG. 4, the cover is first folded over the bottom side 54 of the board (i.e., one lateral edge 56 of the cover is folded across the upwardly facing bottom side of the board since the bottom side is more sensitive to damage than is the top side). A second fold is then made over the bottom side of the board (i.e., the other lateral edge 57 of the cover is folded over the board on top of the first fold) to provide a double layer of protective covering along and over the central portion of the bottom side of the board. Straps 18 and 20 are then fastened by conventional fasteners 58 and 59 to secure the positioning of the cover and to also provide an anchor for the handle 26, as shown in FIG. 5.

Figure 6:
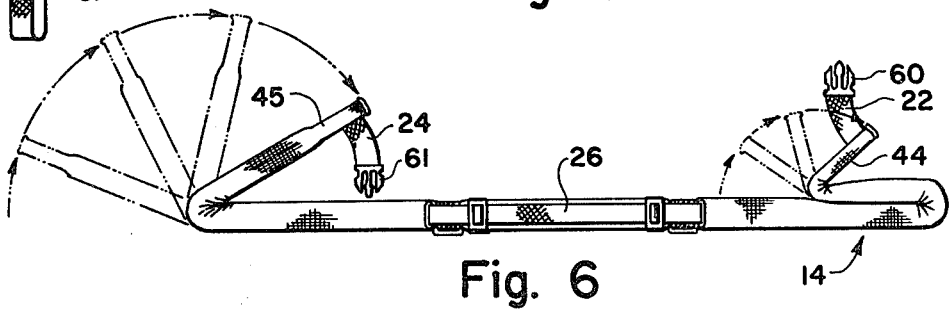
FIGS. 6 and 7 are top edge views of the protective cover to illustrate progressive folding steps following those shown in FIG. 5 to complete the assembly of the cover to the fully assembled condition as shown in FIG. 1.
Figure 7:
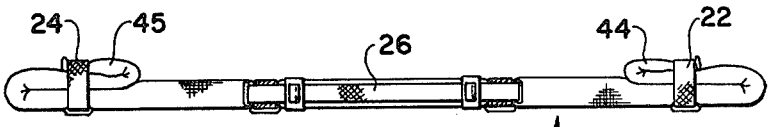

As shown in FIGS. 6 and 7, the board is then turned so that the folds of the cover face downwardly (i.e., lateral edges 56 and 57 are below the board). The longitudinal ends 44 and 45 of the cover are then folded over the ends of the board with the edges being then folded back to provide a dual fold thereat and so that straps 22 and 24 can be used to fasten the ends 44 and 45 tightly against the nose and tail portions 33 and 34 of the board by conventional fasteners 60 and 61. The board is thus encapsulated in the cover with added protection for the more sensitive portions. As can be appreciated from the foregoing, the completed assembly could be versatile in providing protection to more than one piece of equipment, and could, for example, also include two covers having straps 22 and 24 encircling both to effectively make a single assembly for carrying purposes. Due to the reinforcing strip 47 there is no gathering of the cover at the edges (as might occur with the reduced dimensions of a surfboard at the ends), and the pockets are within the assembled package (it should be noted, however, that the pockets are accessible without unwrapping the cover).

Figure 8:
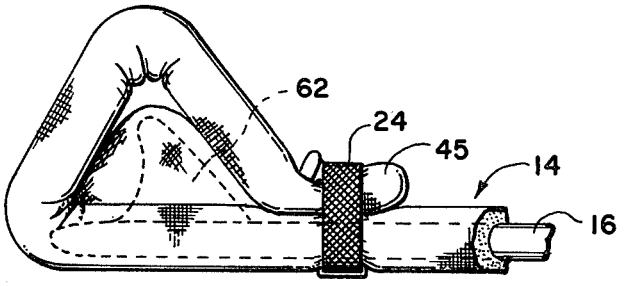
FIG. 8 is a partial side view of the protective cover showing protection provided to a surfboard having a skeg affixed thereto.

If the structural fin, or skeg, 62 of the board is not removable, the protective cover of this invention allows the skeg to be protected. In this event, the board is preferably placed with the top facing up on the unfolded cover and, as shown in FIG. 8, the fold of the cover is over the board and strap 24 is fastened beyond the skeg.

Figure 9:
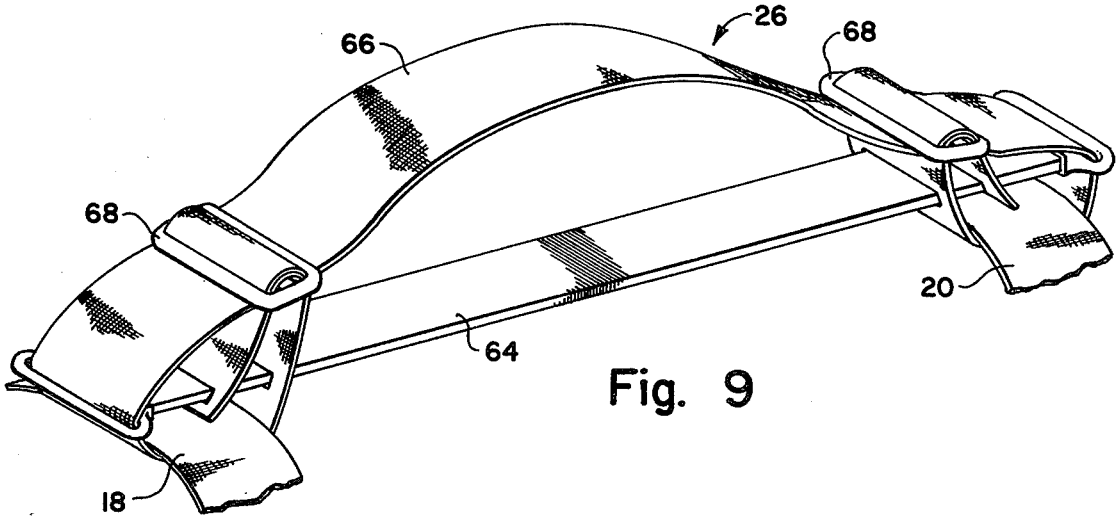
FIG. 9 is an expanded perspective view showing the handle portion of the protective cover.

Handle 26 is provided to form the assembled cover into a carrier, or tote bag. As shown in greater detail in FIG. 9, a rigid reinforcing strip 64 extends between straps 18 and 20. A handle strap 66 (of nylon or polypro, for example) is then threaded through a pair of apertures at each end of reinforcing strip 64 and handle adjustment buckles 68 are used to control the effective length of the strap and to move the effective grip longitudinally for load balancing. If strap 66 is adjusted to have an effective length only slightly greater than the length of strip 64, a handle is provided that can be hand gripped. If strap 66 is adjusted to have a greater effective length, then a shoulder strap is provided.

Figure 10:
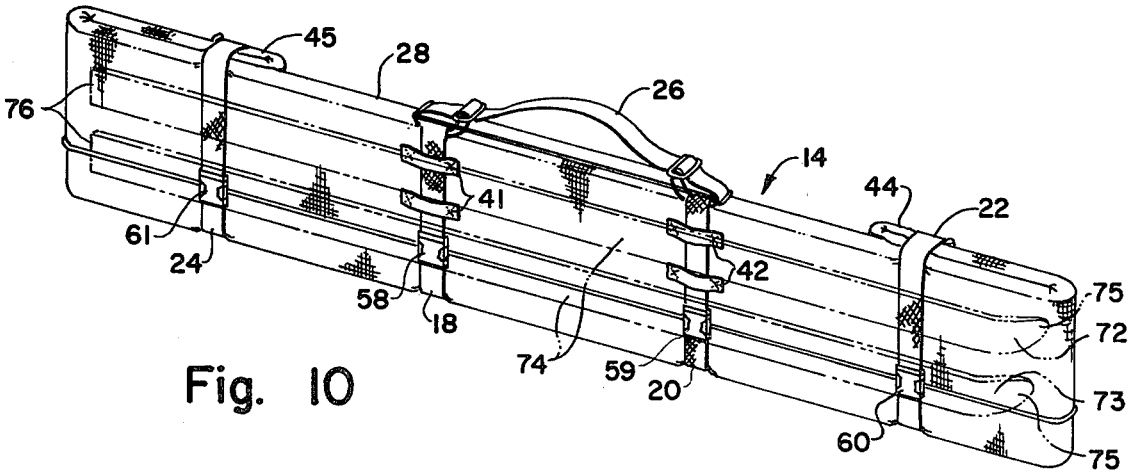
FIG. 10 is a perspective view of the protective cover in assembled condition used to protect a pair of skis.

FIG. 10 shows the protective cover used for protecting a pair of skis 72 and 73 and providing a carrier therefor. As shown, the assembly is the same for protecting the bottoms 74 and ends 75 of the skis in the same manner as has been described hereinabove with respect to the surfboard. While not specifically shown in FIG. 10, the skis could be back-to-back, for example, and still be protected by the cover of this invention.

From the foregoing, it can be seen that this invention provides an improved protective cover and carrier for sports equipment.

What is claimed is:

1. A protective cover for elongated sports equipment, said cover comprising:

an outer layer of material having inner and outer sides and a length and width greater than said elongated sports equipment;

an inner layer of foam material at said inner side of said outer layer, said inner layer having a length greater than said elongated sports equipment but less than that of said outer layer, with said inner layer being positionable adjacent to said elongated sports equipment;

first and second straps;

retaining means fastened to said outer side of said outer layer for positioning said straps across the width of said outer layer at the central portion thereof, said first and second straps holding said cover wrapped about said elongated sports equipment with dual layers over the bottom of said elongated sports equipment;

third and fourth straps attached to said outer side of opposite ends of said outer layer and extending across the width thereof, said third and fourth straps holding said cover wrapped about the opposite ends of said elongated sports equipment with at least dual layers of cover about said elongated sports equipment ends; and handle means connected with said first and second straps so that said assembled cover having said elongated sports equipment therein may be readily carried.

2. The cover of claim 1 wherein said outer layer of material is fabric and said inner layer is foam plastic.

3. The cover of claim 1 wherein said cover includes a pair of pockets at the opposite ends of said outer layer, said pockets being within said cover when assembled to protect said equipment.

4. The cover of claim 1 wherein said handle means includes reinforcing means extending between said first pair of straps and a handle strap extending from said reinforcing means.

5. The cover of claim 1 wherein said handle means is adjustable for providing one of an adjustable hand grip for load balancing and a shoulder support.

6. The cover of claim 1 wherein opposite end portions of said cover have reinforcing means spanning the central portion of the width of said cover with said reinforcing means having a length at least equal to the minimum anticipated width of equipment within said cover.

7. A protective cover for a surfboard, said cover comprising:

an outer layer of material having inner and outer sides and a length and width greater than said surfboard;

an inner layer of foam material at said inner side of said outer layer, said inner layer having a length greater than that of said surfboard but less than that of said outer layer, with said inner layer being positionable adjacent to said surfboard;

first and second pockets fastened to said outer layer at the opposite ends thereof and with said pockets extending inwardly therefrom;

first and second straps;

web means fastened to said outer side of said outer layer for positioning said straps across the width of said outer layer at the central portion thereof, said first and second straps holding said cover wrapped about said surfboard with dual layers over the bottom of said surfboard;

third and fourth straps attached to said outer side of said opposite ends of said outer layer and extending across the width thereof, said third and fourth straps holding said cover wrapped about the opposite ends of said surfboard with at least dual layers of cover about said surfboard ends; and handle means connected with said first and second straps so that said assembled cover having said surfboard therein may be readily carried.

8. The cover of claim 1 wherein said cover includes first and second reinforcing means at the opposite ends of said outer layer of said cover, and third reinforcing means at said handle means.

9. The cover of claim 8 wherein said handle means includes a fifth strap connected with said third reinforcing means.

10. The cover of claim 9 wherein said handle means includes strap adjustment means for optionally providing one of a hand grip and a shoulder support.

11. A protective cover for elongated sports equipment, said cover comprising:

an outer layer of material having inner and outer sides and a length and width greater than said elongated sports equipment;

an inner layer of foam material at said inner side of said outer layer, said inner layer having a length greater than that of said elongated sports equipment but less than that of said outer layer, with said inner layer being positionable adjacent to said elongated sports equipment;

first and second pockets fastened to said outer layer at the opposite ends thereof and with said pockets extending inwardly therefrom;

first and second straps;

web means fastened to said outer side of said outer layer for positioning said straps across the width of said outer layer at the central portion thereof, said first and second straps holding said cover wrapped about said elongated sports equipment with dual layers over the bottom of said elongated sports equipment;

third and fourth straps attached to said outer side of said opposite ends of said outer layer and extending across the width thereof, said third and fourth straps holding said cover wrapped about the opposite ends of said elongated sports equipment with at least dual layers of cover about the ends of said elongated sports equipment; and handle means connected with said first and second straps so that said assembled cover having said elongated sports equipment therein may be readily carried.

12. The cover of claim 11 wherein said cover includes first and second reinforcing means at the opposite ends of said outer layer of said cover, and third reinforcing means at said handle means.

13. The cover of claim 12 wherein said handle means includes a fifth strap connected with said third reinforcing means.

14. The cover of claim 13 wherein said handle means includes strap adjustment means for optionally providing one of a hand grip and a shoulder support.

15. A protective cover for a surfboard, said cover comprising:

an outer layer of material having inner and outer sides and a length and width greater than said surfboard;

an inner layer of foam material at said inner side of said outer layer, said inner layer having a length greater than that of said surfboard but less than that of said outer layer, with said inner layer being positionable adjacent to said surfboard;

first and second straps;

retaining means fastened to said outer side of said outer layer for positioning said straps across the width of said outer layer at the central portion thereof, said first and second straps holding said cover wrapped about said surfboard with dual layers over the bottom of said surfboard;

third and fourth straps attached to said outer side of opposite ends of said outer layer and extending across the width thereof, said third and fourth straps holding said cover wrapped about the opposite ends of said surfboard with at least dual layers of cover about said surfboard ends; and handle means connected with said first and second straps so that said assembled cover having said surfboard therein may be readily carried.

* * * * *